US009269514B2

(12) United States Patent
Rodrigues et al.

(10) Patent No.: US 9,269,514 B2
(45) Date of Patent: Feb. 23, 2016

(54) DEVICE FOR PROTECTION AGAINST PARTICLES GENERATED BY AN ELECTRIC SWITCHING ARC

(71) Applicant: Alstom Technology LTD, Baden (CH)

(72) Inventors: Didier Rodrigues, Serpaize (FR); Denis Frigiere, Decines (FR); Jean Marc Willieme, La Mulatiere (FR); Frank Jacquier, Mions (FR)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 14/367,874

(22) PCT Filed: Dec. 21, 2012

(86) PCT No.: PCT/EP2012/076712
§ 371 (c)(1),
(2) Date: Jun. 20, 2014

(87) PCT Pub. No.: WO2013/093033
PCT Pub. Date: Jun. 27, 2013

(65) Prior Publication Data

US 2015/0014279 A1 Jan. 15, 2015

(30) Foreign Application Priority Data

Dec. 21, 2011 (FR) ..... 11 62190

(51) Int. Cl.
*H01H 33/10* (2006.01)
*H01H 33/04* (2006.01)
(Continued)

(52) U.S. Cl.
CPC ..... *H01H 33/10* (2013.01); *H01H 33/04* (2013.01); *H01H 33/08* (2013.01); *H01H 2009/305* (2013.01); *H01H 2033/66269* (2013.01); *H01H 2033/66292* (2013.01)

(58) Field of Classification Search
CPC ..... H01H 9/34; H01H 9/341; H01H 9/48; H01H 2009/305; H01H 33/08; H01H 33/60; H01H 2033/566
USPC ..... 218/41, 57, 77, 136, 147, 155, 156; 361/279, 604, 612
See application file for complete search history.

(56) References Cited

U.S. PATENT DOCUMENTS 3,590,186 A 6/1971 Brunner
3,778,573 A 12/1973 Harrold
(Continued)

FOREIGN PATENT DOCUMENTS

CH 440 413 A 7/1967
DE 893684 C 10/1953
(Continued)

OTHER PUBLICATIONS

Baltensperger, P., "Switching overvoltage in HV and EHV networks", CIGRE 1970 13.14, p. 9, paragraph 5.2.2. (not translated).
(Continued)

*Primary Examiner* — Renne Luebke
*Assistant Examiner* — William Bolton
(74) *Attorney, Agent, or Firm* — Nixon Peabody LLP

(57) ABSTRACT

A protection device for providing protection against the particles generated by an electric arc when a first electrically conductive part and a second electrically conductive part of an electrical connection unit are separated from each other, the protection device including at least one protection element disposed in the proximity of the place at which the first part and the second part separate in order to form a shield against the particles.

6 Claims, 2 Drawing Sheets

(51) Int. Cl.

| | |
|---|---|
| ***H01H 33/08*** | (2006.01) |
| ***H01H 9/30*** | (2006.01) |
| ***H01H 33/662*** | (2006.01) |

(56) References Cited

U.S. PATENT DOCUMENTS

| | | | | | |
|---|---|---|---|---|---|
| 3,898,408 | A | * | 8/1975 | Cookson et al. | 218/43 |
| 3,943,314 | A | | 3/1976 | Frink | |
| 3,970,809 | A | | 7/1976 | Mitchell | |
| 3,984,651 | A | | 10/1976 | Lewis et al. | |
| 4,225,762 | A | * | 9/1980 | Zuckler | 218/156 |
| 4,236,053 | A | * | 11/1980 | Sasaki et al. | 218/57 |
| 4,403,125 | A | * | 9/1983 | Yamaoka et al. | 218/147 |
| 4,419,552 | A | | 12/1983 | Haginomori | |
| 4,617,435 | A | | 10/1986 | Kawasaki | |
| 5,012,051 | A | * | 4/1991 | Tsukushi et al. | 218/71 |
| 5,091,614 | A | | 2/1992 | Yamamoto et al. | |
| 5,109,145 | A | | 4/1992 | Fujita et al. | |
| 5,585,610 | A | * | 12/1996 | Meyer et al. | 218/57 |
| 5,780,799 | A | | 7/1998 | Renaud | |
| 5,837,955 | A | * | 11/1998 | Utsumi et al. | 218/77 |
| 5,898,151 | A | | 4/1999 | Plat et al. | |
| 5,905,242 | A | | 5/1999 | Bernard et al. | |
| 5,952,635 | A | | 9/1999 | Plat et al. | |
| 6,013,888 | A | | 1/2000 | Thuries | |
| 6,211,478 | B1 | | 4/2001 | Schoenemann et al. | |
| 6,492,609 | B1 | | 12/2002 | Biquez et al. | |
| 6,593,538 | B2 | | 7/2003 | Perret et al. | |
| 6,751,078 | B1 | | 6/2004 | Munakata et al. | |
| 6,759,616 | B2 | | 7/2004 | Rokunohe et al. | |
| 6,838,631 | B2 | | 1/2005 | Munakata et al. | |
| 6,849,819 | B2 | | 2/2005 | Tresy et al. | |
| 6,881,917 | B2 | | 4/2005 | Kikukawa et al. | |
| 7,091,439 | B2 | | 8/2006 | Vaghini et al. | |
| 7,199,324 | B2 | | 4/2007 | Perret | |
| 7,705,262 | B2 | | 4/2010 | Chassieu et al. | |
| 7,718,913 | B2 | | 5/2010 | Frigiere et al. | |
| 8,081,407 | B2 | | 12/2011 | Willieme et al. | |
| 8,264,803 | B2 | | 9/2012 | Willieme et al. | |
| 8,711,550 | B2 | | 4/2014 | Frigiere et al. | |
| 8,717,745 | B2 | | 5/2014 | Frigiere et al. | |
| 2002/0003128 | A1 | * | 1/2002 | Mahl et al. | 218/43 |
| 2005/0247676 | A1 | * | 11/2005 | Telfer et al. | 218/62 |
| 2012/0204590 | A1 | | 8/2012 | Frigiere et al. | |
| 2012/0205074 | A1 | | 8/2012 | Frigiere et al. | |

FOREIGN PATENT DOCUMENTS

| | | | |
|---|---|---|---|
| DE | 100 16 950 | A1 | 10/2001 |
| EP | 0 239 783 | A2 | 10/1987 |
| EP | 0 878 817 | A1 | 11/1998 |
| EP | 0 878 817 | B1 | 11/1998 |
| EP | 0877 405 | A1 | 11/1998 |
| EP | 0 982 748 | | 3/2000 |
| EP | 1 005 058 | | 5/2000 |
| EP | 1 005 058 | A2 | 5/2000 |
| EP | 0 982 748 | A1 | 3/2001 |
| EP | 1 108 261 | | 6/2001 |
| EP | 1 117 114 | A2 | 7/2001 |
| EP | 1 310 970 | A1 | 5/2003 |
| EP | 1 583 124 | A1 | 10/2005 |
| EP | 1 653 491 | A2 | 5/2006 |
| FR | 2738389 | A1 | 3/1997 |
| WO | WO 97/08723 | A | 3/1997 |
| WO | WO 00/05735 | A1 | 2/2000 |
| WO | WO 2013/093033 | A1 | 6/2013 |

OTHER PUBLICATIONS

European Search Report in European Patent Application No. EP 07 11 0719, mailed Aug. 16, 2007.
French Search Report in French Patent Application No. FR 0650155, mailed Oct. 18, 2006.
French Search Report in French Patent Application No. FR 0651709, mailed Jan. 16, 2007.
French Search Report in French Patent Application No. FR 0652628, mailed Feb. 20, 2007.
International Preliminary Report on Patentability in International Patent Application No. PCT/EP2012/076712, mailed Jul. 3, 2014.
International Search Report in International Patent Application No. PCT/EP2007/050318, mailed Apr. 27, 2007.
International Search Report in International Patent Application No. PCT/EP2007/050329, mailed Mar. 21, 2007.
International Search Report in International Patent Application No. PCT/EP2012/076712, mailed Mar. 28, 2013.
Office Action in U.S Appl. No. 11/799,672, dated Jun. 16, 2009.
Notice of Allowance in U.S. Appl. No. 11/799,672, dated Dec. 17, 2009.
Notice of Allowance in U.S. Appl. No. 11/820,829, dated Jan. 8, 2010.
Office Action in U.S. Appl. No. 12/161,314, dated Sep. 14, 2010.
Office Action in U.S. Appl. No. 12/161,314, dated Apr. 4, 2011.
Notice of Allowance in U.S. Appl. No. 12/161,314, dated Aug. 18, 2011.
Office Action in U.S. Appl. No. 12/161,316, dated Sep. 15, 2010.
Office Action in U.S. Appl. No. 12/161,316, dated Apr. 12, 2011.
Office Action in U.S. Appl. No. 12/161,316, dated Oct. 26, 2011.
Notice of Allowance in U.S. Appl. No. 12/161,316, dated May 29, 2012.
Standard CE156 1987 "Normal values of assigned voltages of the line for on-line close defects".
International Search Report and Written Opinion in International Application No. PCT/EP2012/076712, mailed Mar. 28, 2013.

* cited by examiner

DEVICE FOR PROTECTION AGAINST PARTICLES GENERATED BY AN ELECTRIC SWITCHING ARC

CROSS-REFERENCE TO RELATED PATENT APPLICATION

The present application is a National Stage Application of International Application No. PCT/EP2012/076712 entitled "Device For Protection Against Particles Generated By An Electric Switching Arc" filed Dec. 21, 2012, which claims priority of French Patent Application No. 1162190, filed Dec. 21, 2011, the contents of each are incorporated herein by reference in their entirety.

TECHNICAL FIELD

The invention relates to a device for providing protection against the particles generated by a switching electric arc. Such a device is particularly appropriate for high-voltage (HV) and medium-voltage (MV) switchgear, in particular high-voltage circuit breakers, medium-voltage circuit breakers, and generator circuit breakers.

STATE OF THE PRIOR ART

For the majority of circuit breakers, there is a main electrical circuit intended for passing electric current when the circuit breaker is in the closed position, and a secondary electrical circuit intended for interrupting current when it is desired to place the circuit breaker in the open position.

FIG. 1 is a longitudinal cross-section view of a circuit breaker disclosed in document EP-A-0 982 748 (corresponding to U.S. Pat. No. 6,211,478) and showing a main electrical circuit and a secondary electrical circuit. This figure shows a casing 1 of a circuit breaker presenting a longitudinal axis 2, made up of a metal top portion 3, a metal bottom portion 4, and a central portion 5 made of electrically insulating material connecting portions 3 and 4.

The main electrical circuit includes the top and bottom metal portions 3 and 4 and intermediate metal elements: the contact 6 fastened to the top portion 3, the contact 7 secured to the bottom portion 4 and the movable contact 8 constituted by a succession of fingers and that can be moved to ensure connection between the stationary contacts 6 and 7 (as shown in the portion of the figure on the left of the axis 2) or in order not to ensure connection between the stationary contacts 6 and 7 (as shown in the portion of the figure on the right of the axis 2).

The secondary electrical circuit includes a contact pin 14 that is capable of moving from a high position (see the left portion of the figure) to a low position (see the right portion of the figure) by means of a control member. The contact pin 14 slides along the longitudinal axis 2 while being guided by a slideway 13. In the high position, the contact pin 14 is electrically connected to the top portion 3 of the casing by means of the horizontal partition 9 of the portion 3 fitted at its center with a tulip type contact 11. In the low position, the contact pin 14 is no longer electrically connected to the top portion 3 of the casing 1.

FIG. 1 also shows an arrangement 10 for the switching arc, of volume 18 that is limited by the partition 9, the tulip contact 11, a circular wall 20 made of electrically insulating material, and a partition 15 secured to the portion 4 and fitted at its center with a nozzle 12.

Furthermore, FIG. 1 shows an arcing chamber 16, an electric arc 17, a circular blast slot 19, blast cylinders 21, blast pistons 22, blast channels 23, and check valves 24.

During the operation of opening the circuit breaker, the main contacts (the movable contact 8 and the stationary contacts 6 and 7) separate initially, and the electric current that was passing through those contacts switches to the secondary circuit. That switching gives rise to an electric arc between the stationary contacts and the movable contact. That arc produces sparks that disturb the dielectric strength of the switchgear. To overcome this drawback, document EP-A-0 982 748 recommends the use of materials that withstand electrical erosion. However, although the amount of sparks emitted is then lower, it nonetheless remains critical for the dielectric strength of the switchgear.

SUMMARY OF THE INVENTION

The object of the present invention is to provide a protection device making it possible to limit the impact of the phenomenon of electric arcing, in such a manner as to increase the input/output dielectric strength of the switchgear fitted with this safety device, both in transient conditions and in continuous conditions.

The invention firstly provides a protection device for providing protection against the particles generated by an electric arc when a first electrically conductive part and a second electrically conductive part of an electrical connection unit are separated from each other, the first and the second electrically conductive parts each having a contact surface of cylindrical shape and separation of the first and second parts is performed by relative sliding of one of the contact surfaces on the other contact surface, the protection device including a protection element disposed in the proximity of the place at which the first part and the second part separate and disposed facing one of the contact surfaces in order to form a shield against said particles, the protection element being a cylindrical protection element located outside the cylindrical shapes of the first and second parts, characterized in that the device comprises an other cylindrical protection element located inside the cylindrical shapes of the first and the second parts.

The protection element of the other protection element may then be made of metal or they may be metal-plated.

The protection element of the other protection element may be made of an electrically insulating material.

The protection device may include a supplementary protection element in the form of a ring or a ring sector, located inside the cylindrical shapes of the first and second parts, substantially perpendicular to a sliding direction of the contact surfaces relative to each other and facing a contact surface that is uncovered by the contact surfaces sliding relative to each other. This supplementary protection element may be made of electrically insulating material.

The invention secondly provides a circuit breaker including a main electrical circuit intended for passing electric current when the circuit breaker is in the closed position and a secondary electrical circuit intended for interrupting current in order to place the circuit breaker in the open position, the main electrical circuit including an electrical connection unit fitted with a protection device as defined above for providing protection against the particles generated by an electric arc.

BRIEF DESCRIPTION OF THE DRAWINGS

The invention can be better understood and other advantages and characteristics appear on reading the description below, given by way of non-limiting example, and accompanied by the accompanying figures, in which.

DETAILED DESCRIPTION OF PARTICULAR EMBODIMENTS

The invention finds a particularly advantageous application in the field of circuit breakers having a main circuit for passing continuous current and a secondary circuit for interrupting current. On breaking, the invention makes it possible to deal with the problem of switching between the main circuit and the secondary circuit.

Figure 2:
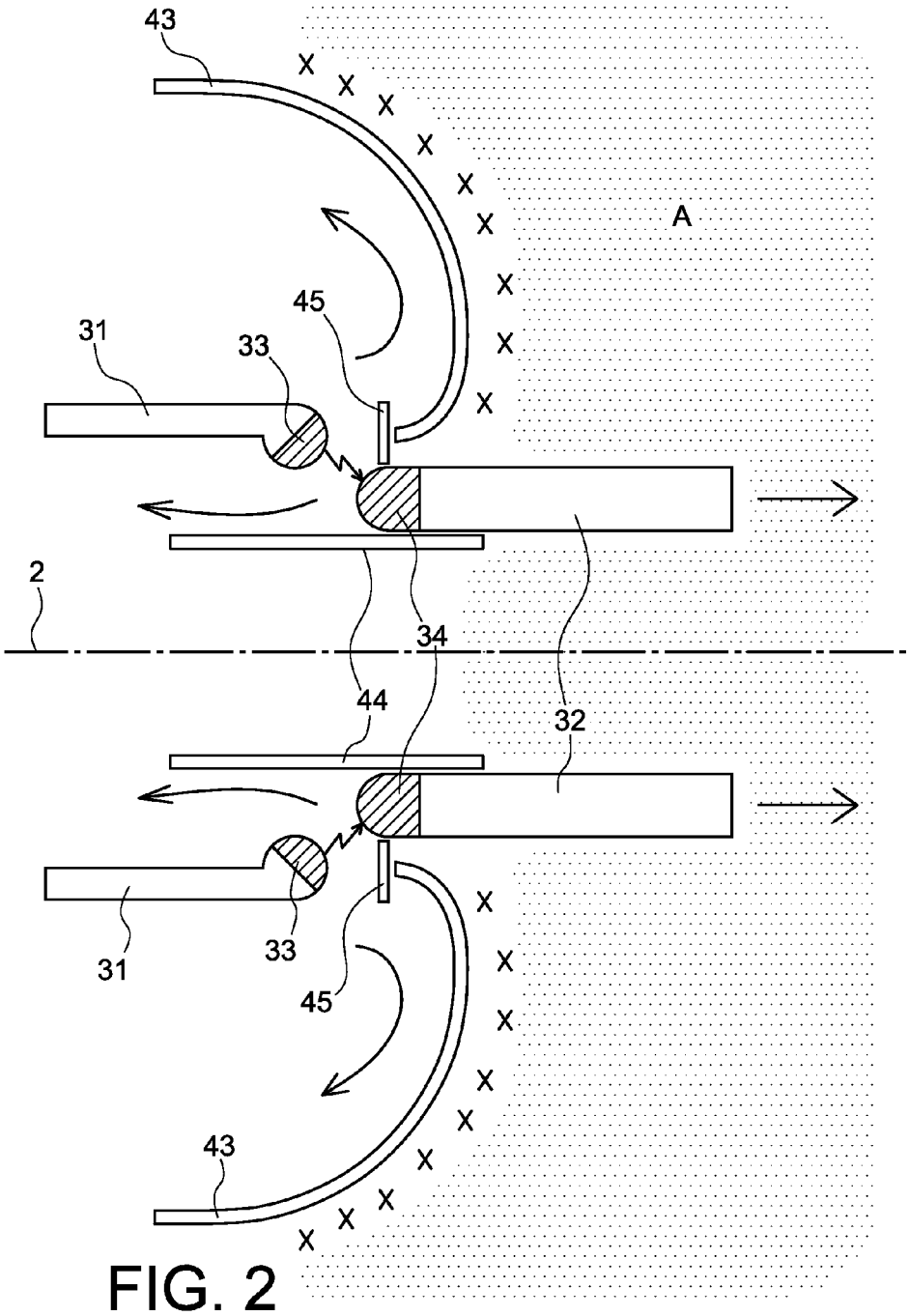
FIG. 2 is a diagram for explaining the operation of the device of the invention for providing protection against the particles generated by a switching arc.

FIG. 2 is a diagram for explaining the operation of the device of the invention for providing protection against the particles generated by a switching arc.

This figure shows two individual parts belonging to an electrical connection unit: a first electrically conductive part 31 (in general, it is a contact finger) and a second electrically conductive part 32. Parts 31 and 32 may be made completely, or in part, or not at all out of materials that withstand electrical erosion particularly well. In FIG. 2, the ends 33 and 34 of the parts 31 and 32 that are intended to be put into contact are provided with a material that is particularly good at withstanding electrical erosion.

For a circuit breaker presenting a main electrical circuit and a secondary electrical circuit, opening of the main circuit is performed by the relative movement of the part 32. During separation of parts 31 and 32, a switching arc appears as shown in FIG. 2, where separation is illustrated by the arrow located on the right of the figure.

FIG. 2 also shows a device for providing protection against the particles generated by the electric arc formed between the ends of parts 31 and 32. In this example embodiment, the protection device includes three protection elements: elements 43, 44, and 45.

Elements 43, 44, and 45 are disposed in such a manner as to trap the particles given off by the switching arc as shown by the curved arrows in FIG. 2.

The element 44 is not always essential. It may be omitted if the configuration of the circuit breaker allows it.

The element 43 is a spark shield, i.e. a shield that retains the particles that have been given off. This element can also perform the function of an anti-corona cap and make it possible to improve distribution of the electric field that exists inside the circuit breaker. For use as an anti-corona cap, the element 43 must be made of metal or be metal-plated.

The elements 44 and 45 are very close to the parts 31 and 32 that move relative to each other and, for this reason, they are made out of electrically insulating material.

The elements 43 and 45 may be made in a single part if said part is made of insulating material. This part may be metal-plated on its side marked by crosses in FIG. 2, and the metal-plating may be set to the electric potential of the part 31.

The protection device of the invention makes it possible to prevent the particles generated by the electric arc from penetrating into the zone A that is a zone that is subjected to a high level of electric stress.

The effectiveness procured by the protection device of the invention is optimized if the conductive part 32 (i.e. the conductive part that in this example is the movable part), or at least its end 34, remains under the element 45 until the switching arc has been extinguished.

By way of example, the elements 43, 44, and 45 are fastened to a stationary portion of the circuit breaker by means available to the person skilled in the art. For a circuit breaker of the type shown in part in FIG. 1, the elements 43, 44, and 45 of the protection device may be fastened to the top portion 3 of the casing 1 in order to provide protection against the particles generated by the electric arc during separation of the stationary contact 6 and the movable contact 8.

Figure 1:
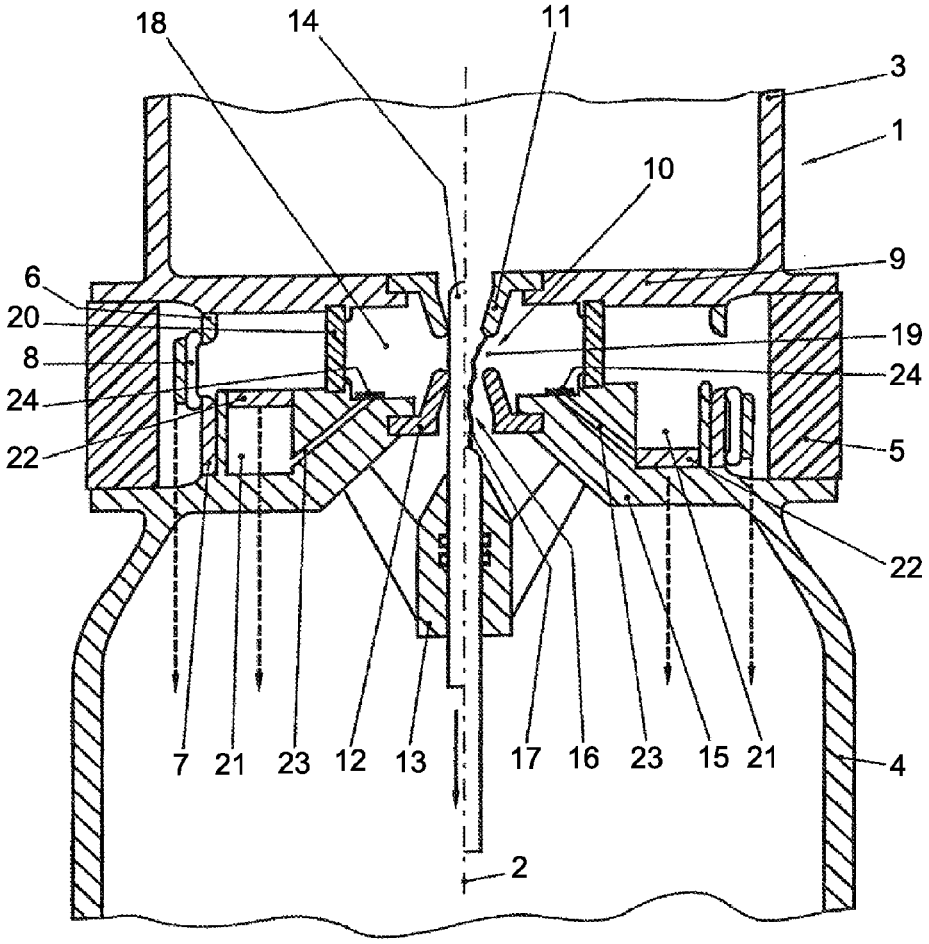
FIG. 1 (PRIOR ART)
FIG. 1 is a longitudinal cross-section view of a prior art circuit breaker.

If, as for the circuit breaker of FIG. 1, the contact surfaces of the first and second parts 31 and 32 are of cylindrical shape, the elements 43 and 44 are also of cylindrical shape and are located on either side of the stationary and movable contacts 6 and 8. The element 45 is thus ring-shaped.

The invention claimed is:

1. A protection device for providing protection against the particles generated by an electric arc when a first electrically conductive part and a second electrically conductive part of an electrical connection unit are separated from each other, wherein the first and the second electrically conductive parts each have a contact surface, wherein the separation of the first and second electrically conductive parts is performed by relative sliding of one of the contact surfaces on the other contact surface, wherein the first and second electrically conductive parts are cylindrically shaped around a revolution axis and demarcate a radially outer region from a radially inner region which includes the revolution axle, wherein, in a radial direction from the revolution axis, the contact surfaces of the first and second electrically conductive parts are arranged between a first protection element and a second protection element, wherein the first protection element is cylindrically shaped around the revolution axis and located in the inner region, and wherein the second protection element is disposed in the proximity of the place at which the first part and the second electrically conductive parts separate and disposed facing one of the contact surfaces in order to form a shield against said particles, the second protection element being cylindrically shaped around the revolution axis and being located in the outer region.

2. A protection device according to claim 1, wherein the first protection element or the second protection element are made of metal or are metal-plated.

3. A protection device according to claim 1, wherein the first protection element or the second protection element are made of electrically insulating material.

4. A protection device according to claim 1, including a third protection element in the form of a ring or a ring sector arranged around the revolution axis, located in the inner region substantially perpendicular to a sliding direction of the contact surfaces relative to each other and facing a contact surface that is uncovered by the contact surfaces sliding relative to each other.

5. A protection device according to claim 4, wherein the third protection element is made of electrically insulating material.

6. A circuit breaker including a main electrical circuit intended for passing electric current when the circuit breaker is in the closed position and a secondary electrical circuit intended for interrupting current in order to place the circuit breaker in the open position, the main electrical circuit including an electrical connection unit fitted with a protection device for providing protection against the particles generated by an electric arc when a first electrically conductive part and a second electrically conductive part of an electrical connection unit are separated from each other, wherein the first and the second electrically conductive parts each has a contact surface, wherein the separation of the first and second electrically conductive parts is performed by relative sliding of one of the contact surfaces on the other contact surface, wherein the first and second electrically conductive parts are cylindrically shaped around a revolution axis and demarcate a radially outer region from a radially inner region which includes the revolution axle, wherein the contact surfaces of the first and second electrically conductive parts are arranged between a first protection element and a second protection element in a radial direction from the revolution axis, wherein the first protection element is cylindrically shaped around the revolution axis and located in the inner region, and wherein the second protection element is disposed in the proximity of the place at which the first and the second electrically conductive parts separate and disposed facing one of the contact surfaces in order to form a shield against said particles, the second protection element being cylindrically shaped around the revolution axis and being located in the outer region.

* * * * *